US005730079A

United States Patent [19]

Totty et al.

[11] Patent Number: 5,730,079

[45] Date of Patent: Mar. 24, 1998

[54] ELECTROLUMINESCENT LIGHT FOR NIGHT FISHING

[76] Inventors: Kirby R. Totty, 507 Landon Dr., Nashville, Tenn. 37220; Carey M. Ray, 491 Gibbs La., Gallatin, Tenn. 37066

[21] Appl. No.: 760,379

[22] Filed: Dec. 4, 1996

[51] Int. Cl.[6] ..... B63B 17/00

[52] U.S. Cl. ..... 114/343; 43/4.5; 43/17.5; 114/364

[58] Field of Search ..... 43/17.5, 4.5; 114/343, 114/364; 362/84; 313/512

[56] References Cited

U.S. PATENT DOCUMENTS

| | | | |
|---|---|---|---|
| 2,714,683 | 8/1955 | Jenkins | 313/512 |
| 3,317,722 | 5/1967 | Whitney | 362/84 |
| 3,344,269 | 9/1967 | Brown | 362/84 |
| 3,559,224 | 2/1971 | Shimizu | 43/17.5 |
| 4,494,326 | 1/1985 | Kanamori | 362/84 |
| 5,184,414 | 2/1993 | Downs | 43/17.5 |
| 5,317,488 | 5/1994 | Penrod | 362/84 |
| 5,495,401 | 2/1996 | Evans | 362/84 |

*Primary Examiner*—Sherman Basinger
*Attorney, Agent, or Firm*—Richard L. Huff

[57] ABSTRACT

A lighting system containing a connection to a dc battery, and a lamp containing a watertight, transparent housing, an inverter, a reflector, and a panel containing copper-activated zinc sulfate is useful for night fishing. The lamp produces a light having a wavelength having a narrow band peaking at 507 nm. This light permits the user to distinguish water, shoreline, and foliage without losing night adaptation and without attracting insects.

3 Claims, 6 Drawing Sheets

ELECTROLUMINESCENT LIGHT FOR NIGHT FISHING

BACKGROUND OF THE INVENTION

1. Field of the invention

This invention relates to an electroluminescent lighting system useful for night fishing.

2. Description of the related art

Fishing from boats at night is a popular pastime. However, it is not without its drawbacks and hazards. If no light is used, it may be difficult or impossible to distinguish the water from the shoreline. In this event, the boat may be damaged as a result of hitting the shore or fishing lines may become entangled in foliage along the shoreline. If lights are used, the user may temporarily lose night vision. Also, insects are attracted to light, making the experience more of an aggravation than an enjoyable sport. Thus, there is an existing need for a light which will enable the user to distinguish the shoreline from the water and maintain night vision while not attracting insects.

SUMMARY OF THE INVENTION

The present invention provides a lighting system which connects to an external dc battery. The lighting system comprises a lamp comprising a watertight transparent housing containing an inverter, a reflector and an electroluminescent panel containing copper-activated zinc sulfide. The lamp is able to float in water, thus avoiding its loss in the event it is dropped in the water. The lighting system is adapted to be movably mounted on a fishing boat. The lamp of this invention emits light having a narrow wavelength band peaking at 507 nm. This light enables the user to clearly distinguish the water from the shoreline while maintaining night vision. This light does not have the undesirable characteristic of attracting insects. Thus the needs referred to above are met by the present invention.

DESCRIPTION OF THE PREFERRED EMBODIMENTS

Figure 1:
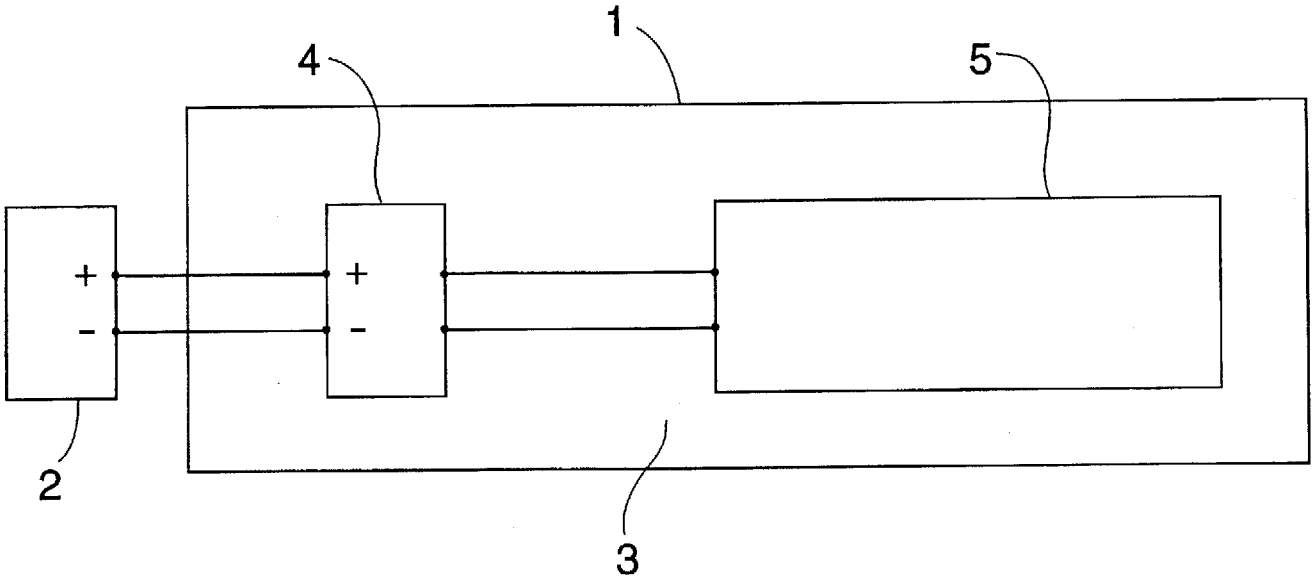
FIG. 1 shows diagrammatic view of the lighting system of the present invention..
Figure 2:
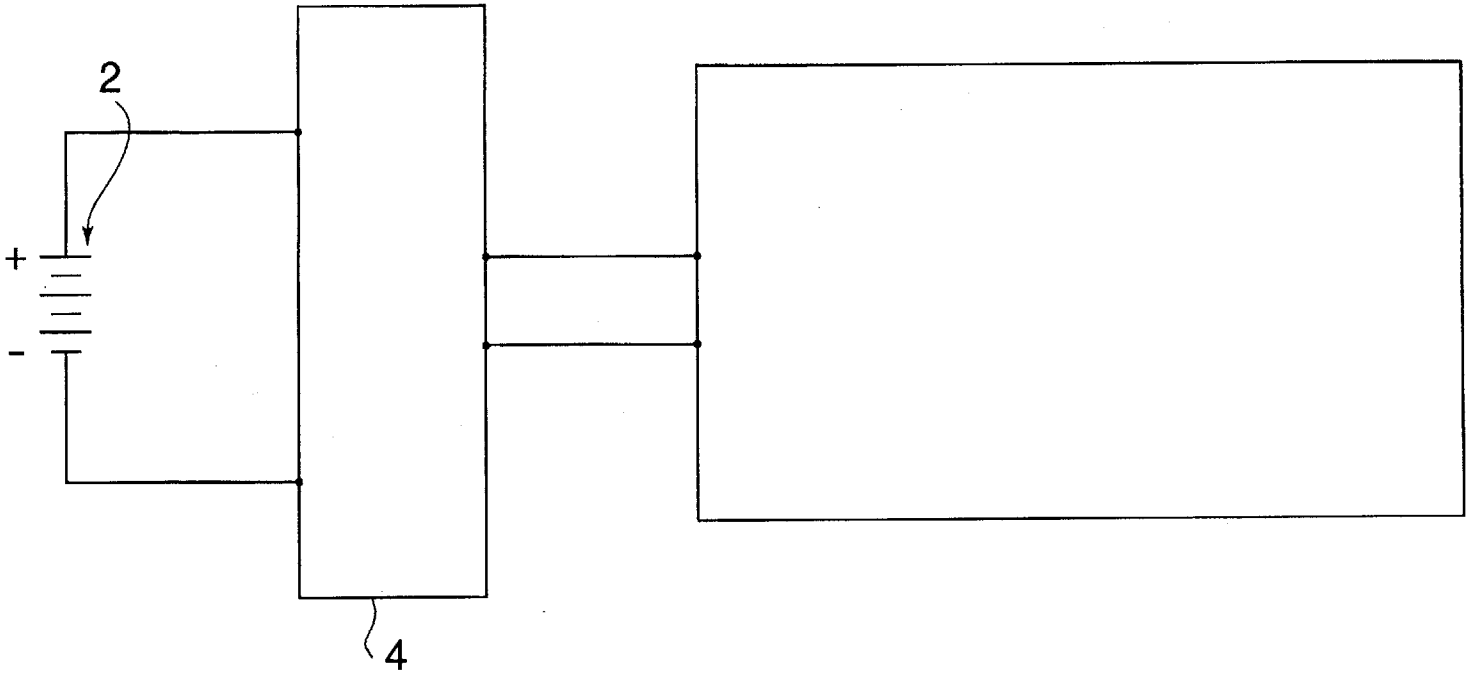
FIG. 2 presents an electrical diagram of the lighting system of this invention.
Figure 3:
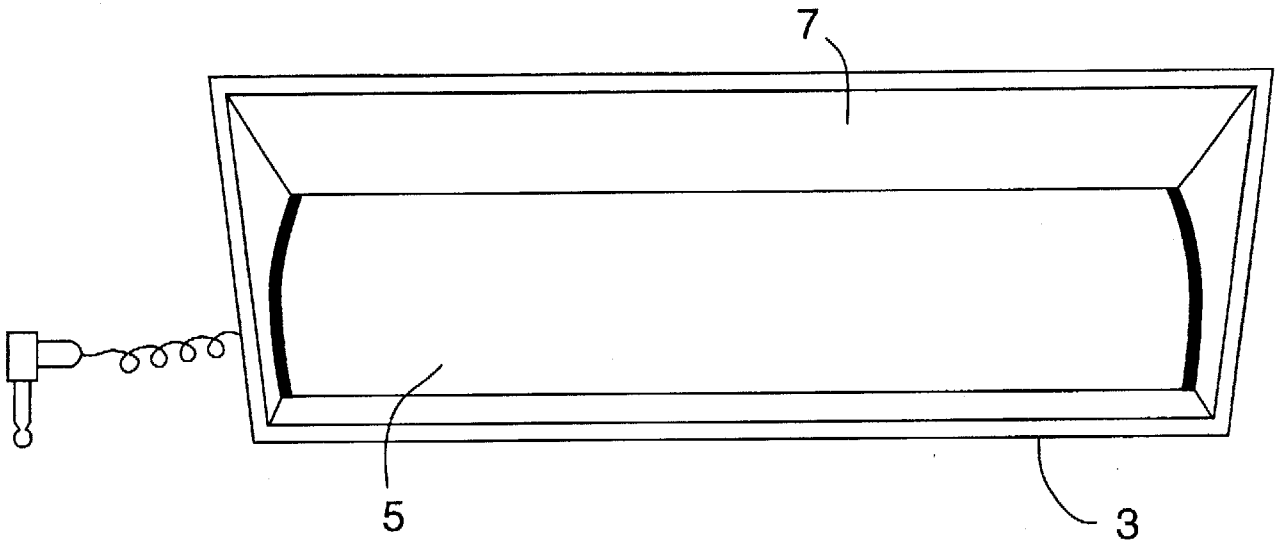
FIG. 3 is an elevational view of one version of the lamp of the present invention.
Figure 4:
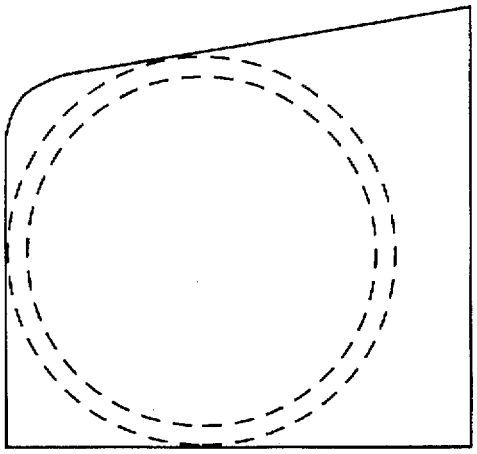
FIGS. 4, 5, 6 and 7 are plan views showing an end view of one version, an end view of another version, a front view, and a rear view of the lamp of the present invention, respectively.
Figure 5:
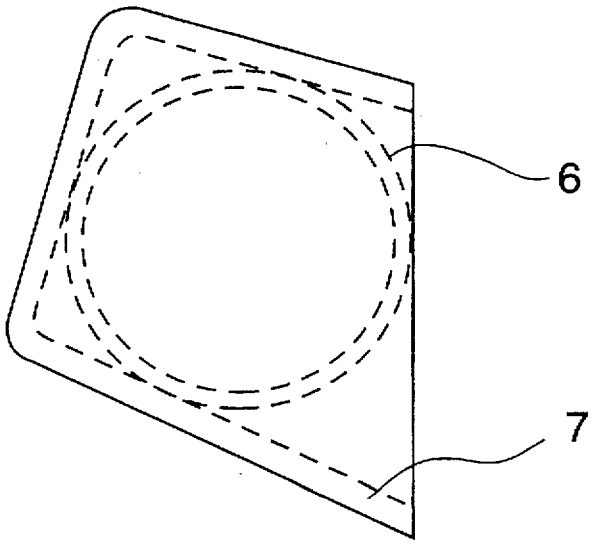
Figure 6:
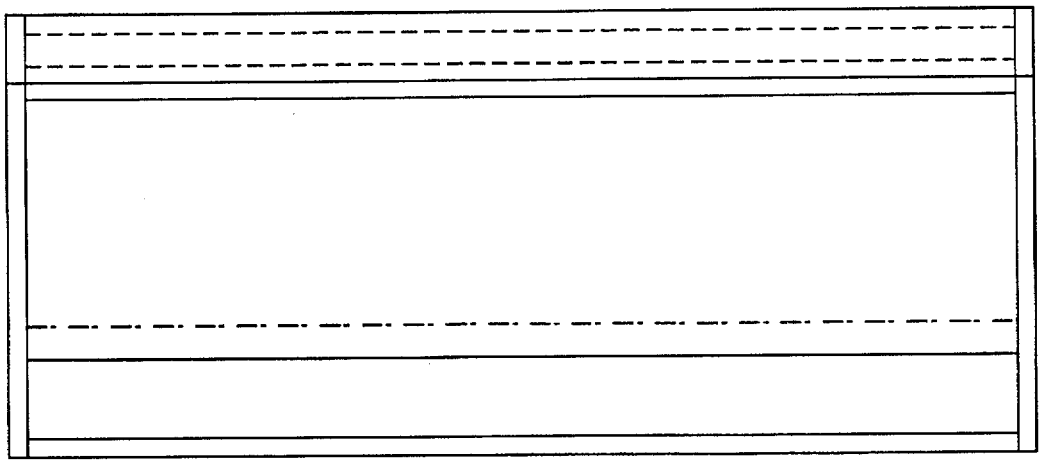
Figure 7:
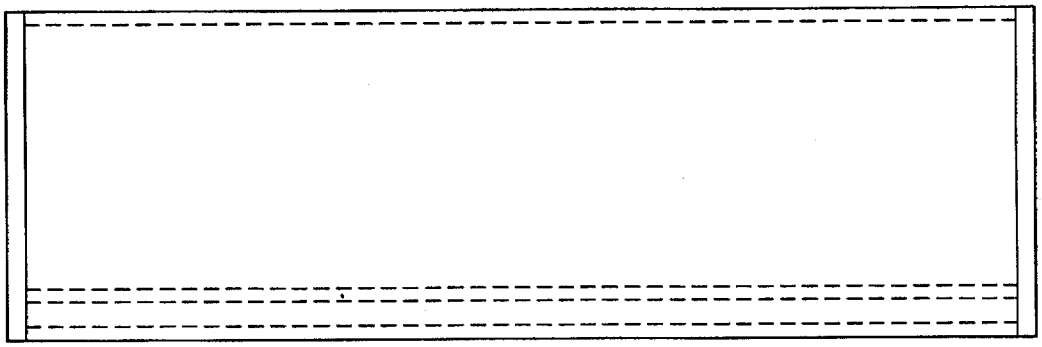
Figure 8:
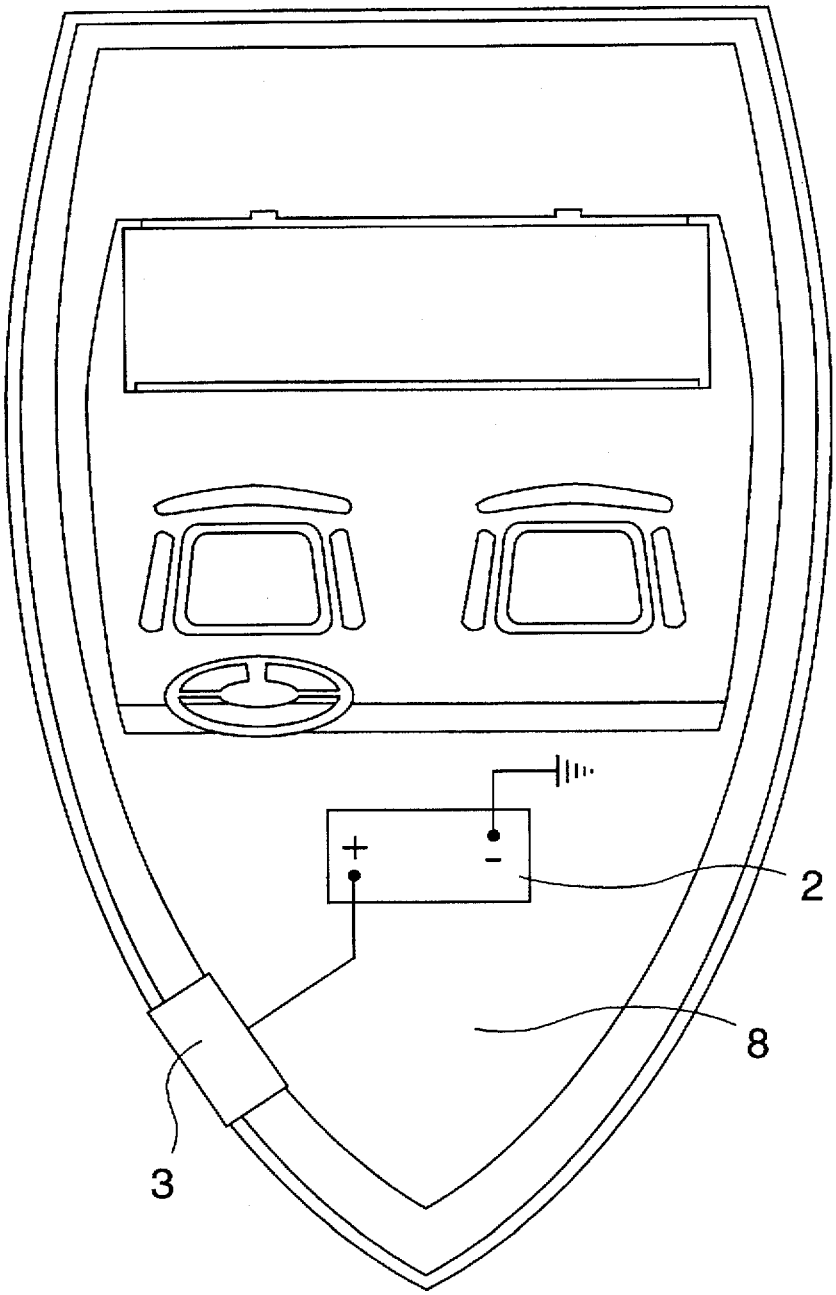
FIG. 8 is a top plan view of a boat having the light of the present invention mounted thereon.

The invention will now be described with reference to the Figures, like numerals referring to like parts throughout.

The lighting system 1 of the present invention is intended to be used by fishermen at night to allow the fishermen to distinguish water from shoreline features while maintaining night vision without the attraction of insects. Accordingly, the lighting system of the invention is used on small vessels

8 propelled on water by engines, oars, Or sails. Examples of such vessels are canoes, rowboats, motorboats, sailboats, launches, runabouts, and yachts. The lighting system 1 of this invention is moveably mounted on a boat so that the beam of light from the lamp may be moved horizontally and vertically within a wide range. Any conventional mounting (not shown) may be used for this purpose.

The lighting system 1 comprises a connection to an external battery source 2 and a lamp 3. The external battery source 2 is a conventional battery capable of providing 12 to 14 volts d.c. The battery 2 is electrically connected to an inverter 4 which is capable of converting the 12 to 14 volts d.c. to 100 to 140 volts a.c., 400 to 800 Hz. The inverter 4 is electrically connected to the panel 5.

The lamp 3 contains a watertight, transparent housing 6, preferably made of a strong plastic, and has a size and weight relationship such that it will float in water in the event it accidentally falls into the water. Inside the housing 6 is an electroluminescent panel 5 which contains copper-activated zinc sulfide phosphors. When activated by the current from the inverter 4, the phosphors emit a light having a narrow wavelength band which peaks at 507 nm with all emitted light within 75 nm of either side of the peak. Lamps having such phosphors are known in the art, and those skilled in the art are aware of methods of making electroluminescent lamps having copper-activated zinc sulfide phosphors. The lamps further contain reflective panels 7 to guide the light outwardly. The size of the light beam and the concentration of light may be easily adjusted by varying the angle of the reflectors 7.

The light system 1 of this invention is used by fishermen at night. The lamp 3 is moveably mounted on a small vessel and may be freely mined from side to side and up and down. The lamp 3 enables the user to clearly distinguish between water and shoreline features so as to avoid grounding the fishing craft or snagging fishing lines in trees or bushes. By using lamps emitting the wavelength band described above, the user does not lose night vision. A great and unexpected advantage of the use of the lamp 3 of the present invention is the fact that insects are not attracted to the wavelength band emitted by the lamp 3. Thus, safe and enjoyable fishing may be provided.

I claim:

1. An electroluminescent lighting system adapted to be moveably mounted on a boat, consisting essentially of a connection to an external source of electricity providing 12 to 14 volts d.c. and a lamp comprising a watertight, transparent housing containing an inverter electrically connected to the source of electricity, which inverter converts the 12 to 14 volts d.c. to 100 to 140 volts a.c.; an electroluminescent panel electrically connected to the inverter, which panel contains copper-activated zinc sulfide phosphors which, upon electrical activation, emit light having a wavelength of 507±75 nm; and reflector panels, said lamp having a size and weight such that it floats in water.

2. The combination of a boat and the electroluminescent lighting system of claim 1 mounted thereon.

3. The process which comprises fishing from a boat having the electroluminescent system of claim 1 mounted thereon wherein the lamp is emitting light.

* * * * *